US008172583B2

(12) United States Patent
Friedrich

(10) Patent No.: US 8,172,583 B2
(45) Date of Patent: May 8, 2012

(54) DISTRIBUTOR ARRANGEMENT FOR ELECTRICAL LINES, IN PARTICULAR SIGNAL LINES

(75) Inventor: Jürgen Friedrich, Halver (DE)

(73) Assignee: Escha Bauelemente GmbH, Halver (DE)

( * ) Notice: Subject to any disclaimer, the term of this patent is extended or adjusted under 35 U.S.C. 154(b) by 0 days.

(21) Appl. No.: 13/059,407

(22) PCT Filed: Aug. 12, 2009

(86) PCT No.: PCT/EP2009/060443

§ 371 (c)(1),
(2), (4) Date: Feb. 16, 2011

(87) PCT Pub. No.: WO2010/020572

PCT Pub. Date: Feb. 25, 2010

(65) Prior Publication Data

US 2011/0151690 A1 Jun. 23, 2011

(30) Foreign Application Priority Data

Aug. 21, 2008 (DE) ..... 10 2008 038 588

(51) Int. Cl.
*H01R 12/00* (2006.01)

(52) U.S. Cl. ..... 439/76.1; 439/954; 439/680; 439/681

(58) Field of Classification Search ..... 439/76.1, 439/954, 680, 681, 677, 535
See application file for complete search history.

(56) References Cited

U.S. PATENT DOCUMENTS

| | | | | |
|---|---|---|---|---|
| 5,735,697 | A | 4/1998 | Muzslay | |
| 6,210,179 | B1 * | 4/2001 | Lausberg et al. | 439/76.1 |
| 6,249,068 | B1 * | 6/2001 | Knopp | 310/71 |
| 6,464,517 | B1 * | 10/2002 | Jones | 439/138 |
| 2004/0171311 | A1 | 9/2004 | Sichner et al. | |

FOREIGN PATENT DOCUMENTS

| | | |
|---|---|---|
| DE | 9313896 | 2/1994 |
| DE | 20004054 | 5/2000 |
| DE | 10011354 A | 7/2001 |
| DE | 102006015718 A | 10/2007 |

* cited by examiner

*Primary Examiner* — Gary F. Paumen
(74) *Attorney, Agent, or Firm* — Lucas & Mercanti, LLP; Klaus P. Stoffel

(57) ABSTRACT

A distributor arrangement for electrical lines, having a housing and a multiplicity of sockets, situated on the housing and each having a contact carrier that has two or more electrical contact elements and an angle encoding feature for inserting plugs in an orientation determined by the angular position of the encoding elements. The distributor arrangement also has a motherboard arranged in the housing and having printed conductors to which the electrical contact elements are connected in an electrically conductive manner by an electrical connecting element. An electrical connecting member, in the form of a connecting board, is associated with the motherboard in one of a multiplicity of preselectable angular positions by the electrical connecting elements located at different radial distances from a center, each connecting element being connected in an electrically conductive manner to one of a plurality of contact sites situated on a circular arc about the center.

13 Claims, 8 Drawing Sheets

DISTRIBUTOR ARRANGEMENT FOR ELECTRICAL LINES, IN PARTICULAR SIGNAL LINES

The present application is a 371 of International application PCT/EP2009/060443 filed Aug. 12, 2009, which claims priority of DE 10 2008 038 588.3, filed Aug. 21, 2008, the priority of these applications is hereby claimed and these applications are incorporated herein by reference.

BACKGROUND OF THE INVENTION

The invention relates to a distributor arrangement for electrical lines, in particular signal lines or the like, having a housing and a multiplicity of sockets situated on the housing, each having a contact carrier that has two or more electrical contact elements and an angle encoding feature for inserting plugs in an orientation determined by the angular position of the encoding elements, and having a motherboard which is situated in the housing and which has printed conductors to which the electrical contact elements are respectively connected in an electrically conductive manner by means of an electrical connecting element.

The invention further relates to a method for manufacturing such a distributor arrangement.

DE 10 2006 015 718 A1 describes a distributor arrangement having a printed circuit board and multiple contact carriers which are permanently associated with the printed circuit board. The contact carrier provides a multiplicity of contact elements which may be brought in contact with mating contact elements of a plug. The contact carrier also provides a coding groove which corresponds to a coding lug of the associated plug. As a result, the plug can be inserted into the socket in only one angular position which is defined by the position of the coding groove. An angle encoding feature is thus provided. The sockets are located on a housing which accommodates the printed circuit board.

Projecting from the top side of the housing are multiple sockets which may be designed for different types of plugs, for example M8 or M12 socket connectors. Each socket may be oriented in eight different angular orientations, for example. The orientation and fitting of the housing with various types of sockets or contact carrier orientations is performed on a customer-specific basis. In the prior art, the contact elements are directly connected to solder lands of the motherboard. As a result, the motherboard may be individually adapted to the particular fittings for the distributor arrangement.

DE 93 13 896 U1 describes a modular distributor plug array. In the cited document, each printed circuit board is equipped with two three-pole equipment sockets and six microswitches, as well as six HF connections.

DE 200 04 054 U1 describes a sensor-actuator distributor for self-assembly, in which multiple connection slots are provided.

SUMMARY OF THE INVENTION

It is an object of the invention to improve the manufacturing for the distributor arrangement referenced at the outset.

As a result of the design according to the invention, in the manufacture of a distributor arrangement a standard motherboard is used which has a multiplicity of contact sites respectively situated on a circular arc about a center 10, 11. Such an internested circular arc arrangement of contact sites is associated with each slot, i.e., each socket. The contact sites cooperate with connecting elements by means of which the motherboard may be connected to a connecting hoard. The connecting elements are located at different radial distances from the center, and are associated with the motherboard in one of a multiplicity of preselectable angular positions. The contact sites may be associated with the motherboard or with the connecting board. The contact sites are preferably formed by printed conductors annularly arranged around the center. The contact sites are offset about the center in a uniform angular distribution. The angles may be 22.5°, 30°, 45°, 60°, or 90°. These predetermined angular patterns define the various positions of the encoding elements. The electrical connecting member, in particular in the form of a connecting board, may thus be connected to the motherboard in one of a multiplicity of preselectable angular positions. Each of the connecting elements situated at an individual radial distance from the center comes into electrical contact with a contact site of a printed conductor which is annularly arranged around the center and individually assigned to the associated contact element. The connecting elements may be electrically conductive pins which are fixedly connected to either the motherboard or to the connecting board. The contact sites, which are preferably formed by solder lands or spring contacts, are then associated with the respective other printed circuit board. The connecting board is permanently associated with the contact carrier. Contact pins which are connected, in particular soldered, to a printed conductor of the connecting board, project from the back end of the contact carrier, which preferably forms a securing portion. The contact elements are connected to the connecting elements in an electrically conductive manner via these printed conductors. The contact elements of a particular contact carrier are situated in various angular positions relative to the center. A central pin which is connected, in particular soldered, to a central solder land may be located in the center. The printed circuit board which bears the annularly arranged printed conductors is preferably formed as a multilayer printed circuit board. Each of the internested annular printed conductors, i.e., the annular contact site arrangement, is associated with a position of the multilayer printed circuit board. Multiple metallic flange sleeves are inserted into the outer side of the housing. A contact carrier is inserted into each of these flanges. The contact carriers have a securing portion, and are inserted into the flange from the inner side of the housing. The securing portions may be clipped to the inner wall of the flange. End portions of the contact elements which are soldered to the connecting board project from the securing portion. In a preferred arrangement, contact pins project from the underside of the connecting hoard, each contact pin being located at a different distance from a central contact pin and being uniformly angularly offset about this contact pin. Each of these contact pins is connected in an electrically conductive manner to a contact element of the contact carrier via a printed conductor of the connecting hoard. Various modules of this type having different designs of contact carriers are provided; however, the configuration of the connecting elements at the underside of the connecting board is standardized so that each of these differently designed modules may be connected to the motherboard at each slot by means of a plug association. Depending on the desired angular orientation of the encoding element, which preferably is formed by a groove, the connecting elements formed by pins contact one of numerous solder lands of the annular printed conductor which is associated with the respective connecting element. The pin is then soldered to the solder land from the back side of the motherboard. In a variant of the invention, the annularly arranged printed conductors are associated with the connecting board. The connecting elements, which in this variant are likewise formed by pins, are then associated with the motherboard, and here as well are each located at an individual distance from a center. The association of the connecting board, or of the module having the connecting board and composed of the connecting board and contact carrier, is then likewise carried out by means of a plug association. Here as well, the electrical connection may be established by soldering. However, a contact spring arrangement may be provided instead of a soldered connection.

BRIEF DESCRIPTION OF THE DRAWING

An exemplary embodiment of the invention is explained below with reference to the accompanying drawings, which show the following.

DETAILED DESCRIPTION OF THE INVENTION

Figure 1:
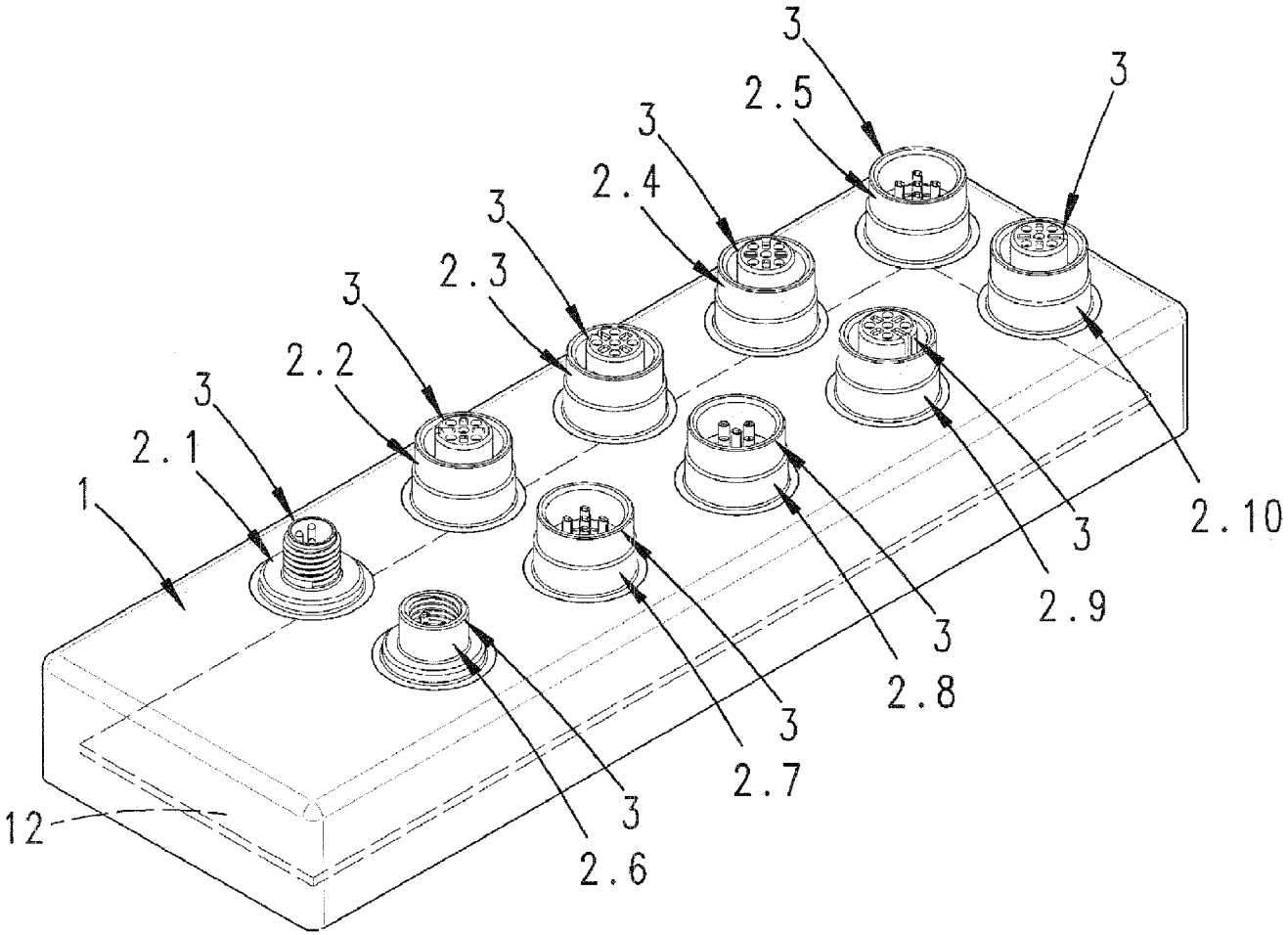
FIG. 1 shows a perspective top view of a housing equipped with a total of ten slots, each slot having an individual socket type or size or orientation.

The distributor arrangement described in the exemplary embodiment comprises a housing 1, made of plastics, having a base shell and a cover shell. The cover shell is provided with a total of ten slots. Two parallel rows having five sockets 2.1 through 2.5 and 2.6 through 2.10, respectively, are provided. Each of the ten slots is equipped with an individually designed and/or oriented socket 2.1 through 2.10.

Sockets 2.1 through 2.10 are each composed of a metal flange 13 which is used to mechanically secure a plug. This metal flange 13 is connected to a sleeve-shaped projection 16 which protrudes into the interior of the housing. The flange 13 may be pressed into this sleeve-shaped projection 16. At its edge projecting into the interior of the housing, the sleeve-shaped projection 16 has positioning gaps 15, arranged in a uniform angular distribution, for the insertion of positioning teeth 17 of a contact carrier 3.

In the installed position, the contact carrier 3 is located inside the flange 13, and in each case has an encoding element 5 and a multiplicity of contact elements 4.1 through 4.4.

The two sockets 2.1 and 2.6 each provide three contact elements which are arranged in such a way that they form an angle encoding feature as a result of their disposition. Namely, the associated mating plug may be put together with the three contact elements of sockets 2.1 and 2.6 in only one angular orientation. For socket 2.1, the contact elements are formed by pins, and for socket 2.6 the contact elements are formed by insertion openings for pins.

Sockets 2.2 through 2.5 and 2.7 through 2.10 have identical contact carriers 3. These contact carriers 3 each have four contact elements 4.1 through 4.4 in the form of insertion openings for contact pins of a plug. Each of these contact carriers 3 has a coding groove 5, so that the associated plug may be brought into connection with the contact carrier in only one angular orientation which is defined by the angular position of the coding groove.

The above-mentioned positioning, teeth 17 are formed by a rear securing portion 14 of the contact carrier 3 that has an enlarged diameter. The securing portion 14 is inserted into the flange 13 from the back, and engages with the inner wall of the flange 13. A total of four contact pins, one associated with each element 4.1 through 4.4, project from the rear end face of the contact carrier 3. The contact pins of contact elements 4.1 through 4.4 are soldered to a connecting board 7. The connecting board 7 is substantially square in plan view, with the corners chamfered.

Figure 2:
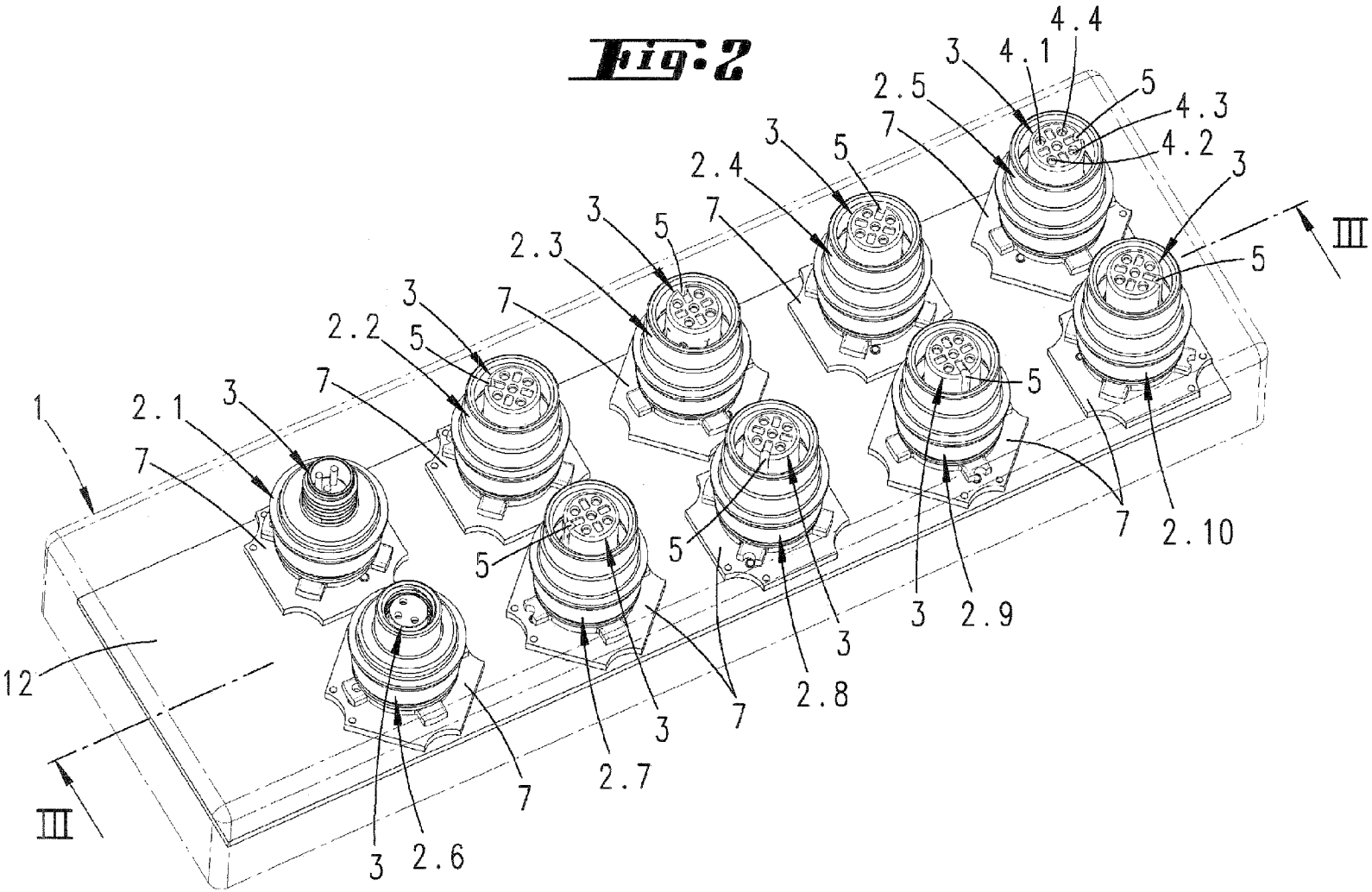
FIG. 2 shows an illustration according to FIG. 1, with the housing blanked out.
Figure 3:
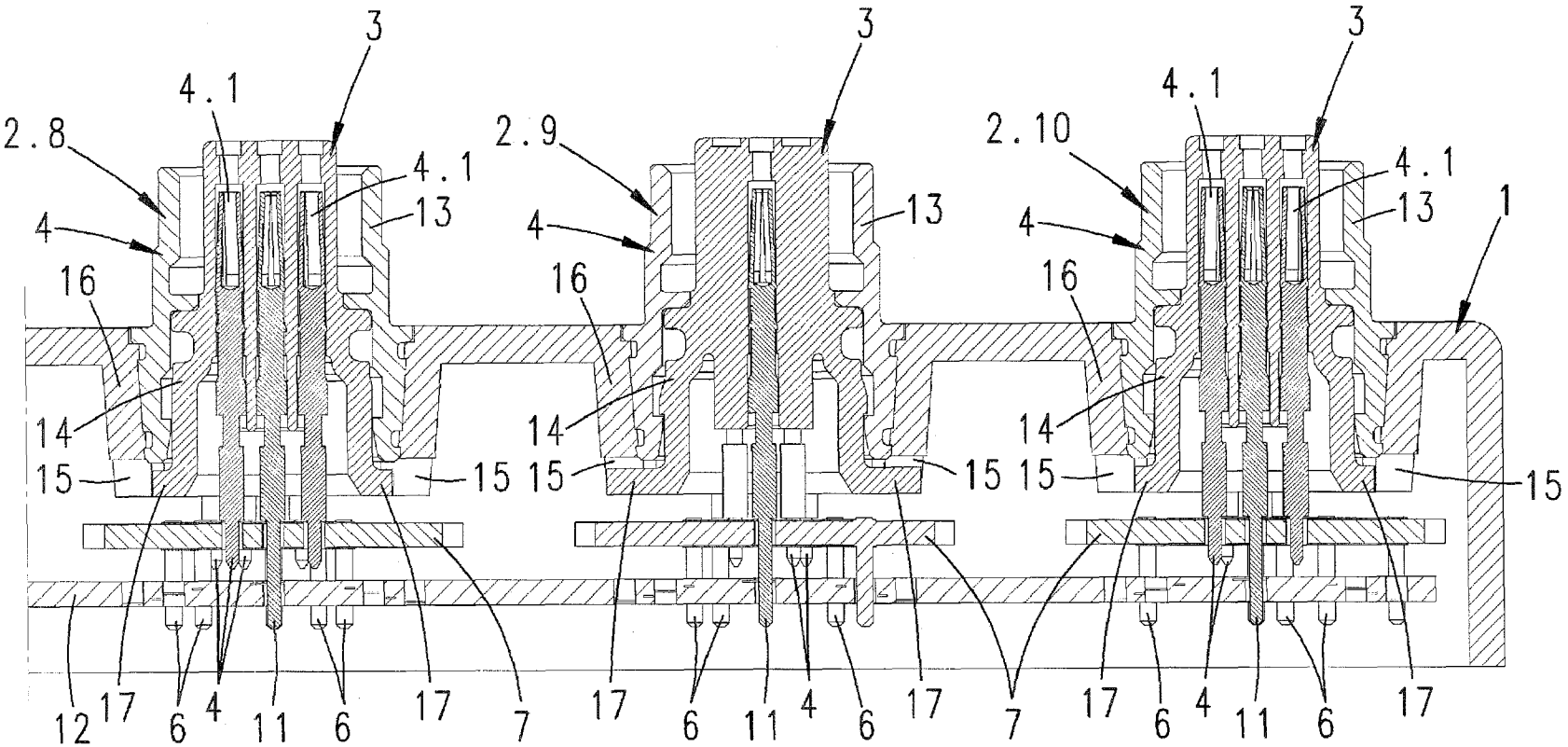
FIG. 3 shows a section according to line III-III in FIG. 2.

As shown in FIG. 2, the connecting boards 7 may be associated with the motherboard 12 in various angular positions in a 45° pattern.

Figure 4A:
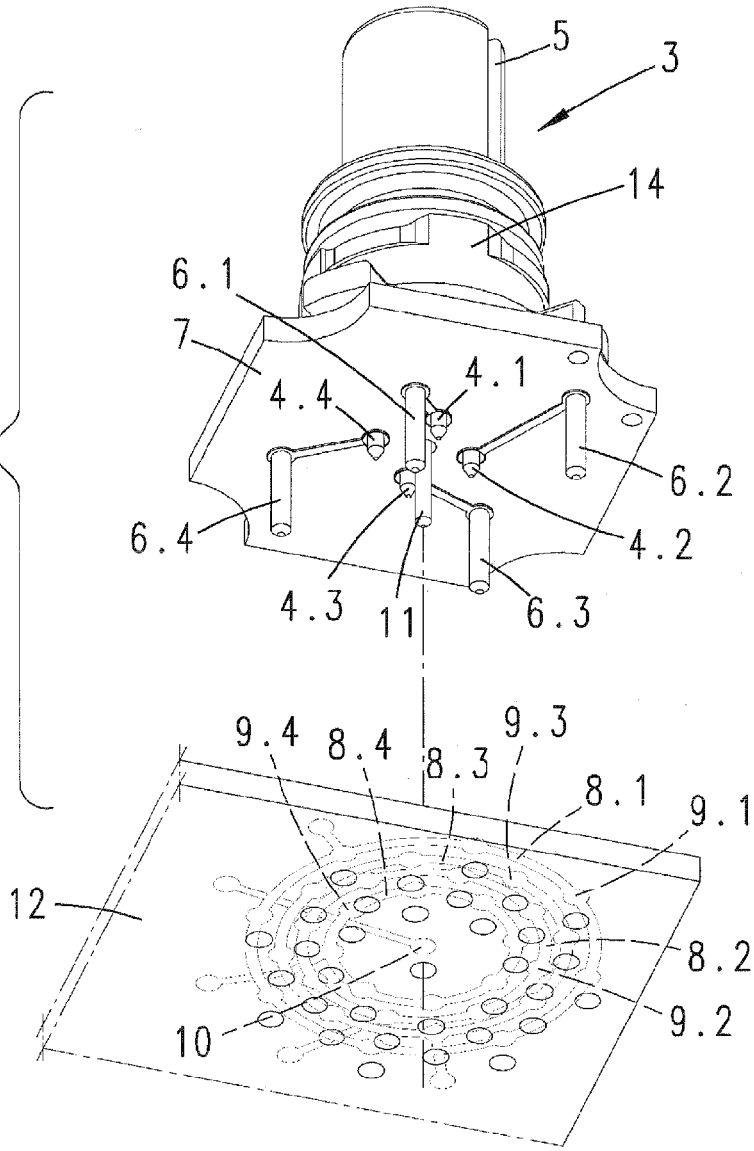
FIGS. 4*a*, 4*b*, and 4*c* show perspective illustrations of a module composed of a connecting board 7 and a contact carrier 3 which is electrically and mechanically connected thereto, in various angular positions.
Figure 4B:
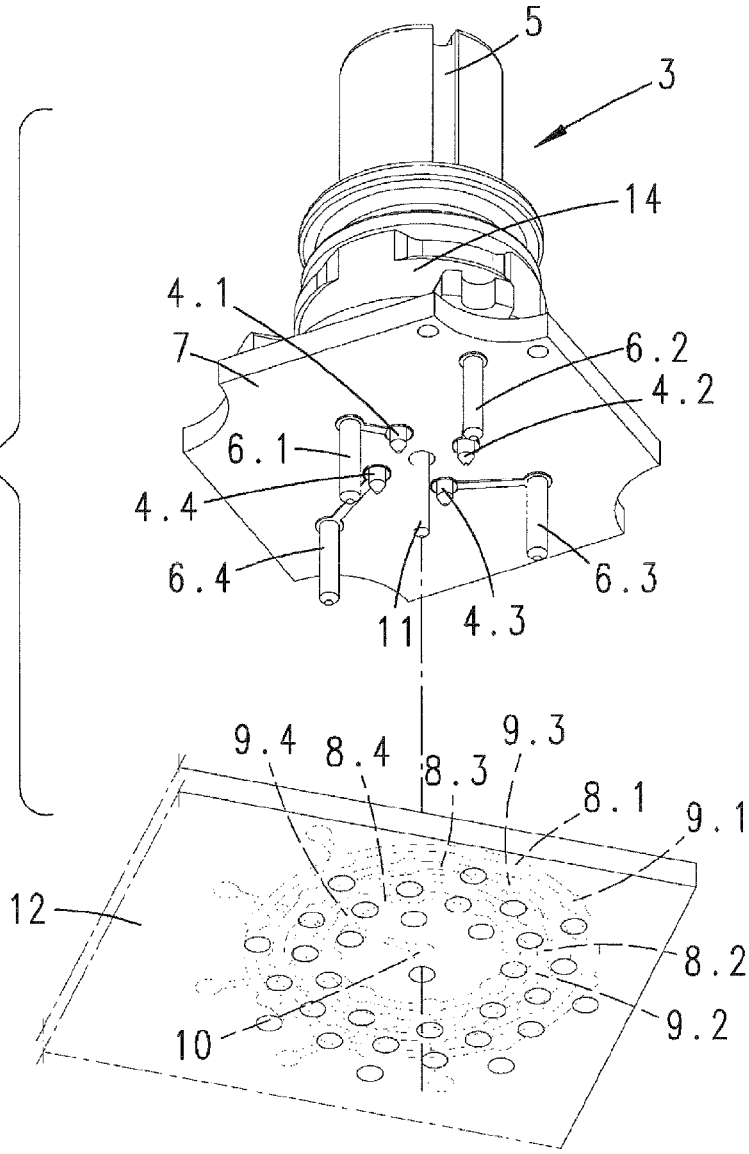
Figure 4C:
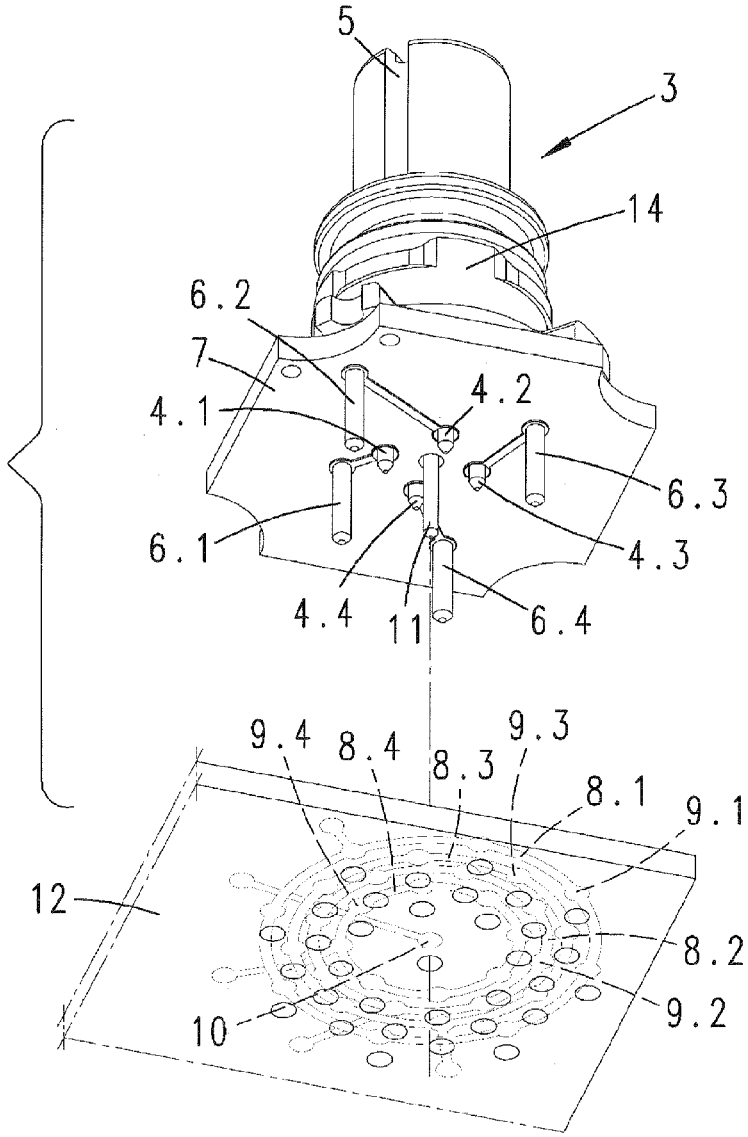
Figure 5:
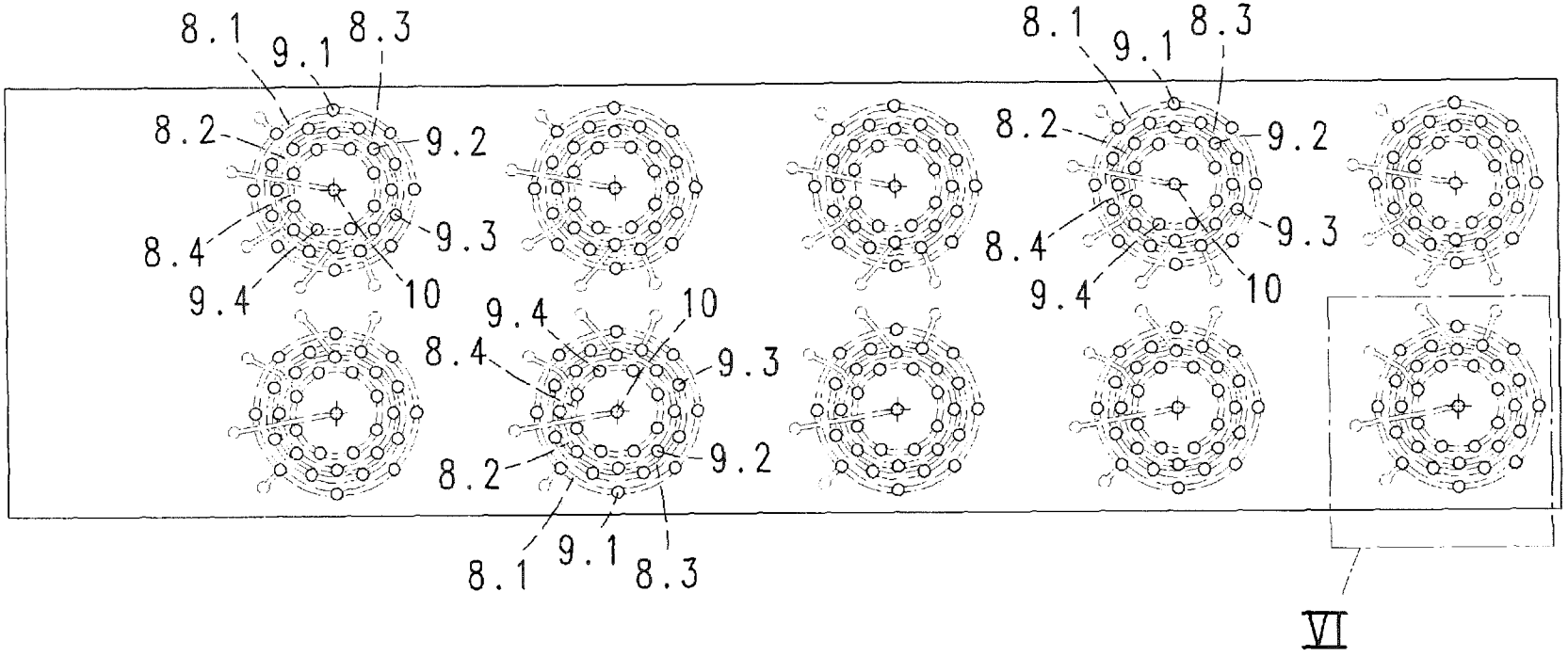
FIG. 5 shows the top view of the printed circuit board in the region of a slot, with all annular printed conductors 8.1 through 8.4 and contact sites 9.1 through 9.4 formed by the annular printed conductors being visibly represented.

As shown in FIGS. 4*a* through 4*c*, four connector pins 6.1 through 6.4 are individually associated with a contact element 4.1 through 4.6, respectively, via printed conductors. These pins, referred to as connecting elements 6, project from the underside of the connecting board 7, and are located at an individual distance from a central pin 11.

Figure 6:
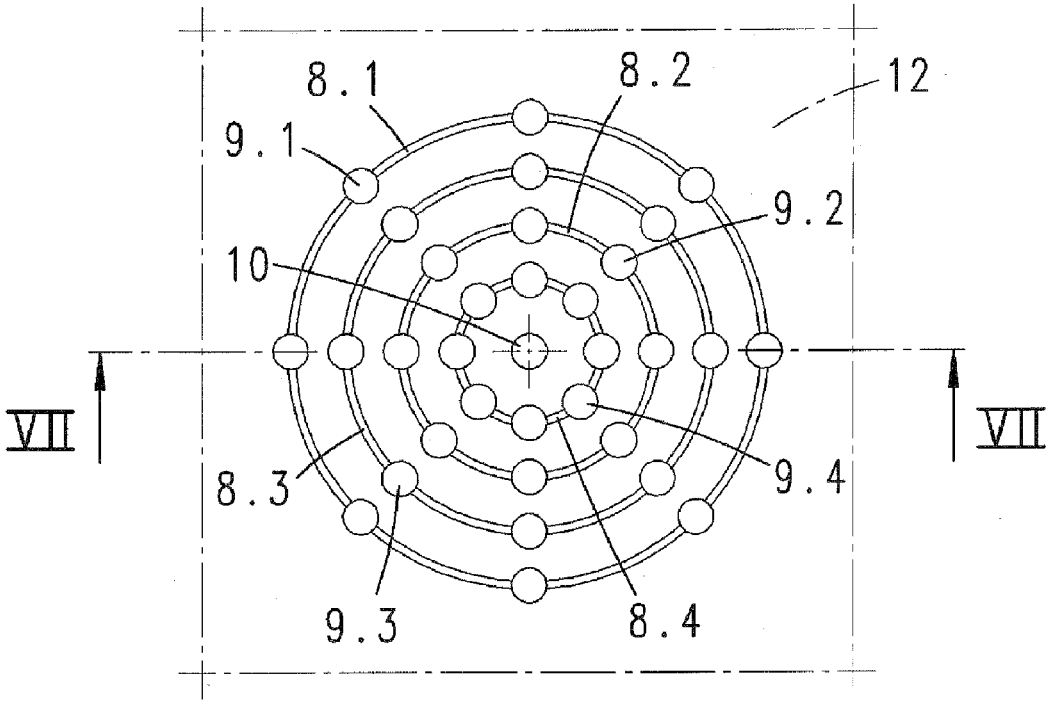
FIG. 6 shows a detail from FIG. 5.
Figure 7:
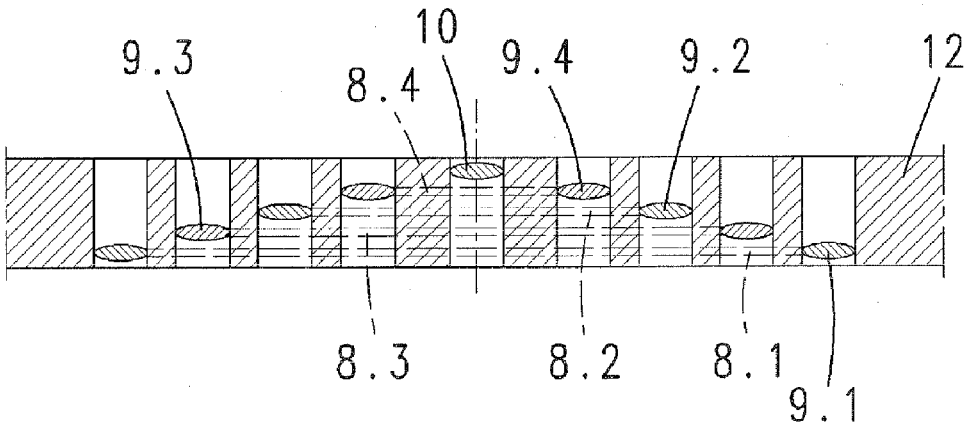
FIG. 7 shows a section according to line VII-VII in FIG. 6.

A motherboard 12 which is a multilayer printed circuit board extends within the housing 1, substantially over the entire interior of the housing. Contact zones having the same design are respectively associated with each of the ten sockets 2.1 through 2.10. One of these ten contact zones is illustrated in an enlargement in FIG. 6.

The contact zone is composed of four annular printed conductors 8.1 through 8.4, nested one within the other. Each of these printed conductors 8.1 through 8.4 is associated with a different position of the printed circuit board, which has a total of four positions. The fifth layer of the printed circuit board 12 on the hack side forms a central contact site 10 in the form of a solder land. In the exemplary embodiment, each annular printed conductor 8.1 through 8.4 bears eight contact sites 9.1 through 9.4, in the form of solder lands, which are offset by 45°. Other angular patterns may also be used. The distances of connecting elements 6.1 through 6.4 from the central pin 11 correspond to the distances of printed conductors 8.1 through 8.4 from the central solder land 10.

Depending on the desired orientation of the coding groove 5, the module formed from a connecting board 7 together with contact carriers 3 secured thereto (see FIGS. 4*a* through 4*c*) is brought into connection with contact sites 9.1 through 9.4 of the motherboard 12, each contact pin 6.1 through 6.4 passing into a solder land 9.1 through 9.4 of a respective printed conductor 8.1 through 8.4 associated with the contact pin.

The connecting boards 7, which are identical with one another, may be combined into modules using differently designed contact carriers 3. These modules may be connected to a universally usable multilayer printed circuit board in orientations which are determined by the particular angular pattern. The connection may be established by soldering, or also by means of a contact spring connection. Pins 6.1 through 6.4 may also be connected to the associated contact site 9.1 through 9.4, respectively, using a press-in technique when, unlike the exemplary embodiment illustrated, contact sites 9.1 through 9.4 are associated with the connecting board 7, and contact pins 6.1 through 6.4 are associated with the motherboard 12. In that case, the motherboard does not have to be a multilayer printed circuit board. However, the connecting board 7 is then preferably a multilayer printed circuit board, a two-layer printed circuit board generally being sufficient.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application.

The invention claimed is:

1. A distributor arrangement for electrical lines, comprising:

a housing;

a multiplicity of sockets arranged on the housing, each of the sockets having a contact carrier that has at least two electrical contact elements and an angle encoding element for inserting plugs in an orientation determined by an angular position of the encoding elements;

a motherboard arranged in the housing and having printed conductors to which the electrical contact elements are respectively connected in an electrically conductive manner by an electrical connecting element; and an electrical connecting member associated with the motherboard in one of a multiplicity of preselectable angular positions by the electrical connecting elements located at different radial distances from a center, each connecting element being connected in an electrically conductive manner to one of a plurality of contact sites respectively situated on a circular arc about the center.

2. The distributor arrangement according to claim 1, wherein the contact sites, which are formed by either the motherboard or the connecting member and which are associated with a contact element, rest on printed conductors arranged annularly about the center.

3. The distributor arrangement according to claim 1, wherein the contact sites are in each case offset about the center in a uniform angular distribution.

4. The distributor arrangement according to claim 3, wherein the contact sites are in each case offset about the center in a uniform angular distribution of 22.5°, 30°, 45°, 60°, or 90°.

5. The distributor arrangement according to claim 1, wherein the connecting elements are electrically conductive pins, and the contact sites are formed by solder lands or sockets.

6. The distributor arrangement according to claim 1, wherein the contact elements of the contact carriers are connected to the connecting member in a fixed angular position in relation to the angular position of the encoding element.

7. The distributor arrangement according to claim 1, wherein the contact elements are situated in various angular positions in relation to the center.

8. The distributor arrangement according to claim 1, further comprising a central contact element which is situated in the center.

9. The distributor arrangement according to claim 1, wherein the motherboard or the connecting member bearing the contact sites is a multilayer printed circuit board.

10. The distributor arrangement according to claim 1, wherein the electrical connecting elements are contact pins permanently associated with the connecting member, and the contact sites are provided by the motherboard.

11. The distributor arrangement according to claim 1, wherein the electrical connecting elements are contact pins permanently associated with the motherboard, and the contact sites are provided by the connecting member.

12. The distributor arrangement according to claim 9, wherein the annularly internested printed conductors are associated with individual levels of the multilayer printed circuit board.

13. A method for manufacturing a distributor arrangement according to claim 1, comprising the steps of: using a motherboard having a multiplicity of contact sites respectively situated on a circular arc about a center, and having a multiplicity of sockets, to be situated on a housing and each having a contact carrier having two or more contact elements and an angle encoding element, for inserting plugs in an orientation determined by the angular position of the encoding element; connecting the contact elements to a connecting member which is individually associated with the socket; and connecting the connecting member in an electrically conductive manner to the contact sites in a multiplicity of preselectable angular positions by electrical connecting elements located at different radial distances from the center.

* * * * *